US007051623B2

(12) United States Patent
Chaconas

(10) Patent No.: US 7,051,623 B2
(45) Date of Patent: May 30, 2006

(54) PAWL-LESS RATCHET WRENCH

(75) Inventor: Peter C. Chaconas, Glyndon, MD (US)

(73) Assignee: Easco Hand Tools, Inc., Simsbury, CT (US)

( * ) Notice: Subject to any disclaimer, the term of this patent is extended or adjusted under 35 U.S.C. 154(b) by 0 days.

(21) Appl. No.: 10/900,014

(22) Filed: Jul. 27, 2004

(65) Prior Publication Data

US 2005/0115366 A1 Jun. 2, 2005

Related U.S. Application Data

(60) Provisional application No. 60/490,641, filed on Jul. 28, 2003.

(51) Int. Cl.
*B25B 13/46* (2006.01)

(52) U.S. Cl. ..... 81/60; 81/58.5

(58) Field of Classification Search ..... 81/60, 81/58.5, 467

See application file for complete search history.

(56) References Cited

U.S. PATENT DOCUMENTS

| | | | | |
|---|---|---|---|---|
| 127,902 | A | 6/1872 | Leonard | |
| 161,022 | A * | 3/1875 | Freeman | 81/58.5 |
| 1,191,873 | A | 7/1916 | Cressey et al. | |
| 3,349,653 | A | 10/1967 | Kaufman et al. | |
| 3,709,073 | A | 1/1973 | Kurtz | |
| 3,838,614 | A | 10/1974 | O'Donnell | |
| 3,875,828 | A | 4/1975 | Evans | |
| 4,770,071 | A | 9/1988 | Steier | |
| 4,796,492 | A | 1/1989 | Liou | |
| 4,807,500 | A | 2/1989 | Main | |
| 4,889,020 | A | 12/1989 | Baker | |
| 4,909,106 | A | 3/1990 | Foreman | |
| 4,991,468 | A | 2/1991 | Lee | |
| 5,197,358 | A | 3/1993 | Hsu | |
| 5,454,283 | A | 10/1995 | Stefano | |
| 5,467,672 | A | 11/1995 | Ashby | |
| 5,653,151 | A * | 8/1997 | Blacklock | 81/60 |
| 5,709,137 | A * | 1/1998 | Blacklock | 81/467 |
| 5,842,391 | A * | 12/1998 | Chaconas | 81/60 |
| 5,996,453 | A * | 12/1999 | Blacklock | 81/467 |
| 6,595,088 | B1 * | 7/2003 | Kuo et al. | 81/58.5 |

FOREIGN PATENT DOCUMENTS

| | | |
|---|---|---|
| DE | 188953 | 9/1907 |
| DE | 227089 | 9/1909 |
| DE | 835877 | 4/1952 |
| GB | 2223970 | 4/1990 |

* cited by examiner

*Primary Examiner*—David B. Thomas
(74) *Attorney, Agent, or Firm*—Nelson Mullins Riley & Scarborough LLP

(57) ABSTRACT

The present invention provides a wrench having a handle integral with a ratchet head. The ratchet head defines a chamber having a generally circular sidewall. An annular rotor having radial teeth about an outer surface thereof is located in the chamber. The rotor teeth engage a set of teeth extending radially inward from the sidewall of the chamber. A biasing element, such as a leaf spring, is provided to urge the rotor teeth into engagement with the sidewall teeth. Preferably, the sidewall teeth will be configured having progressively increasing heights in the direction in which the rotor turns during ratcheting.

19 Claims, 5 Drawing Sheets

PAWL-LESS RATCHET WRENCH

PRIORITY CLAIM

This application claims the benefit of provisional application Ser. No. 60/490,641, filed Jul. 28, 2003, which is relied upon herein and incorporated herein by reference.

BACKGROUND OF THE INVENTION

The present invention relates generally to the art of hand tools. More particularly, the present invention relates to a ratchet wrench which operates without the use of a pawl.

Many types of ratchet wrenches have been provided over the years. As is well known to those in the art, the ratchet mechanism permits the wrench to transmit torque in one rotational direction but allows free movement in the other rotational direction. As a result, a user is able to operate the wrench efficiently without removing the wrench from the nut or other driven component each time it is to be torqued. In some cases, ratchet heads may be mounted at both ends of the wrench. In other cases, a ratchet head will be mounted at one end of the wrench handle with an open box head provided at the other end.

Generally speaking, ratchet wrenches utilize a pawl having teeth that engage a rotatable ratchet wheel. The ratchet wheel is retained within an opening located in the head of the wrench. The ratchet wheel may define a configured opening to directly engage a nut or to receive a particular insert tool. In other cases, the ratchet wheel may carry a tang for use with a variety of different sized sockets.

Ratchet wrenches that function without the use of pawls are known in the art. For example, U.S. Pat. No. 5,842,391 to Chaconas, incorporated herein by reference, discloses such a wrench. While many existing pawl-less wrenches have worked generally well, there exists room in the art for additional novel constructions.

SUMMARY OF THE INVENTION

The present invention recognizes and addresses the foregoing disadvantages, and others, of prior art constructions and methods.

The present invention provides a wrench having a handle integral with a ratchet head. The ratchet head defines a chamber having a generally circular sidewall. An annular rotor having radial teeth about an outer surface thereof is located in the chamber. The rotor teeth engage a set of teeth extending radially inward from the sidewall of the chamber. A biasing element, such as a leaf spring, is provided to urge the rotor teeth into engagement with the sidewall teeth. Preferably, the sidewall teeth will be configured having progressively increasing heights in the direction in which the rotor turns during ratcheting.

Other objects, features and aspects of the present invention are provided by various combinations and subcombinations of the disclosed elements, as well as methods of utilizing same, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figures 1, 2:
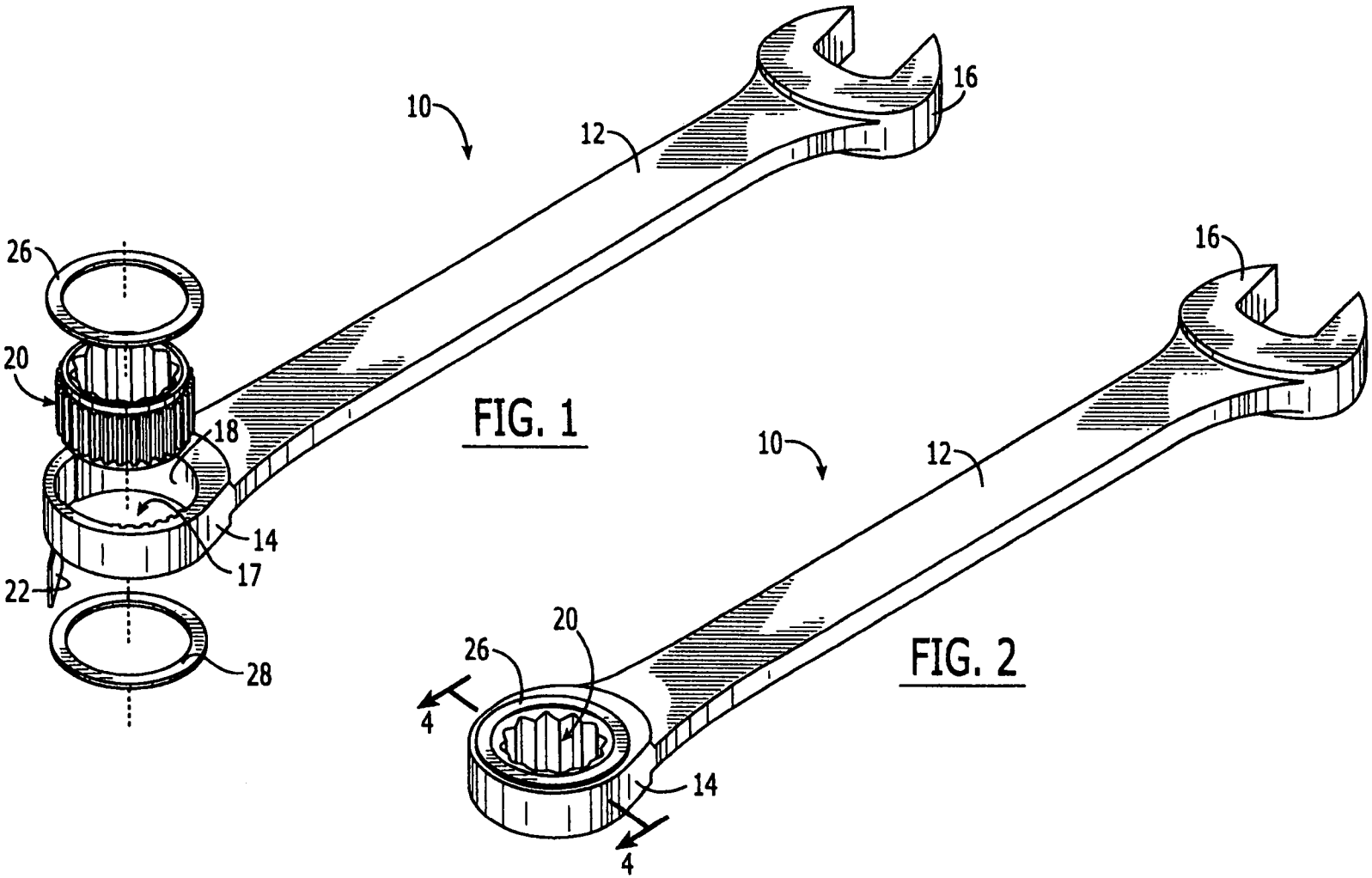
FIG. 1 is an exploded perspective view of a pawl-less ratchet wrench constructed in accordance with the present invention.
FIG. 2 is a perspective view of the wrench of FIG. 1 in assembled condition.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

FIGS. 1 and 2 illustrate a ratchet wrench 10 constructed in accordance with the present invention. As shown, wrench 10 has a handle 12 integral with a ratchet head 14. In this case, the opposite head 16 defines an open end, although one skilled in the art will recognize that ratchet heads of different sizes could be provided at the two ends of wrench 10.

Figure 3:
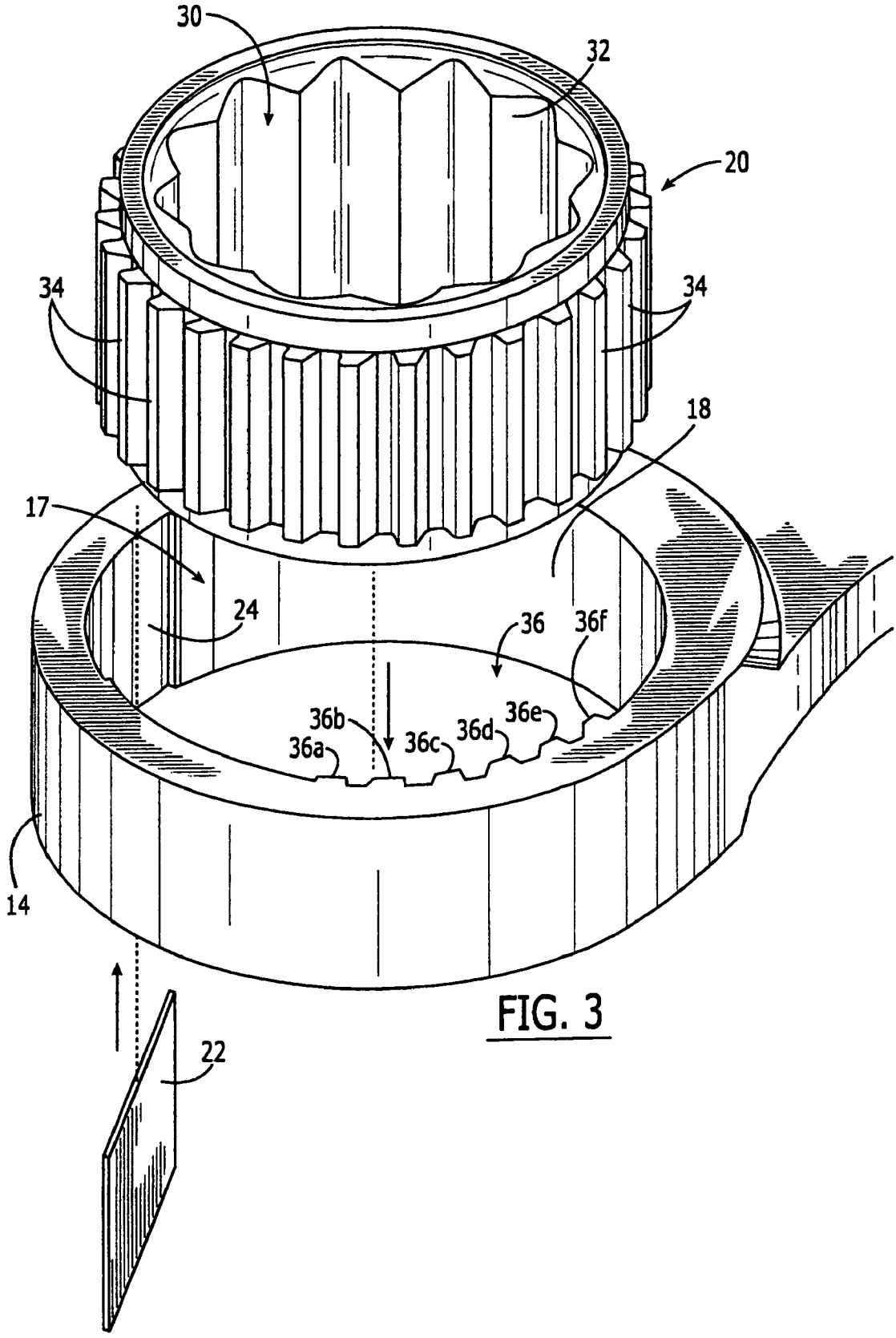
FIG. 3 is an enlarged exploded view showing components of the ratchet mechanism in the wrench of FIG. 1.

Referring now also to FIG. 3, head 14 defines a chamber 17 having a generally circular sidewall 18 thereabout. An annular rotor (or ratchet wheel) 20 is located in chamber 17. A biasing element is provided to facilitate operation of the ratchet mechanism. In this case, for example, the biasing element is configured as a leaf spring 22 located in a recess 24 defined in an arcuate segment of sidewall 18.

Figure 4:
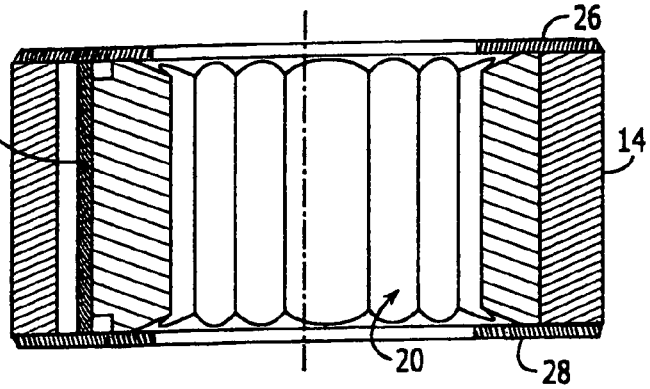
FIG. 4 is a cross-sectional view as taken along line 4—4 of FIG. 2.

Referring to FIGS. 1, 2 and 4, end plates 26 and 28 are provided in the illustrated embodiment to retain rotor 20 within chamber 17. End plates 26 and 28 may be attached to head 14 by any suitable means, such as screws, snap rings or permanent attachment methods.

Figure 5A:
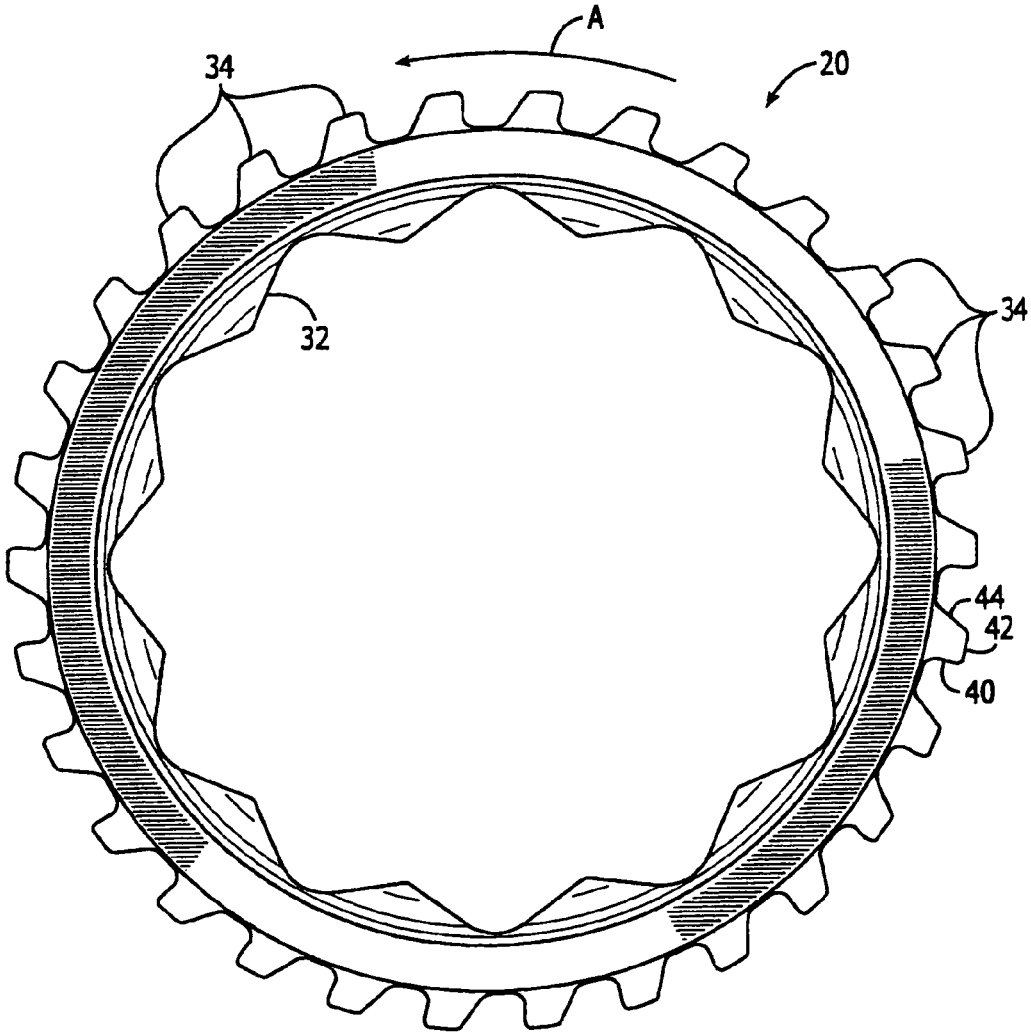
FIG. 5A is an enlarged plan view of the rotor of the ratchet mechanism.

As can be seen in FIGS. 3 and 5A, rotor 20 has a central opening 30 in this embodiment that defines a twelve-point surface 32 for engaging a nut or other component to be torqued. In other embodiments, central opening 30 can be configured to receive an open socket or other tool for performing a desired function. Still further embodiments are contemplated in which rotor 20 does not have a central opening, but instead carries a tang for receipt in a conventional socket.

Rotor 20 further includes a plurality of radial teeth 34 equally spaced about its outer circumferential surface. As will be explained more fully below, teeth 34 engage a set of teeth (generally 36) extending radially inward from sidewall 18. In this case, a total of six such teeth 36*a–f* are provided having progressively increasing heights in the direction that rotor 20 turns.

Figure 5B:
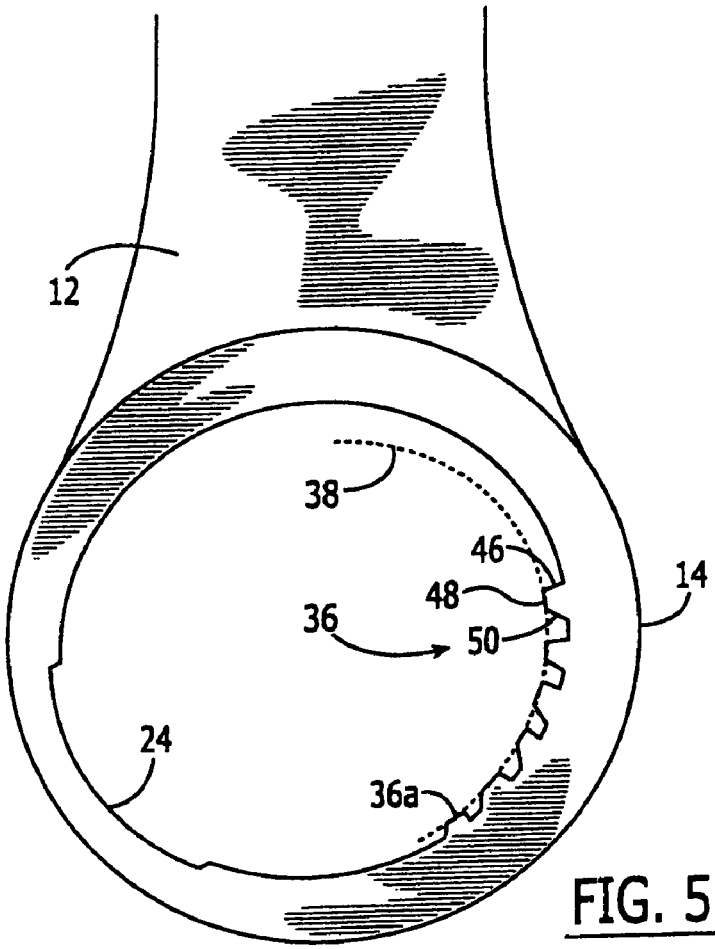
FIG. 5B is an enlarged plan view of the ratchet head without the ratchet wheel mounted therein.

As shown most clearly in FIG. 5B, the top surface of teeth 36*a–f* may preferably follow the contour of a gradual spiral 38 originating ahead of tooth 36*a*. In other embodiments, the tops of teeth 36 may have progressively increasing heights but at the same diameter as chamber 17.

In addition, teeth 36 (along with spring 22) are preferably located in the distal hemisphere of head 14 (i.e., the arcuate segment of head 14 opposite the hemisphere proximal to handle 12). Location of teeth 36 in the distal hemisphere as shown places the first two teeth (36*a* and 36*b*) in a position that prevents loss of re-engagement when handle 12 is pulled down along its axis. In other words, teeth 36*a* and 36*b* will engage even when rotor 20 bears against the surface of sidewall 18 between tooth 36*a* and recess 24. In addition, this portion of sidewall 18 advantageously promotes ratcheting with minimal back torque by providing a fulcrum on which to pivot rotor 20 while compressing spring 22.

Referring to FIG. 5A, it can be seen that teeth 34 each have a forward surface 40, a top surface 42 and a back surface 44. As shown in FIG. 5B, teeth 36 each have a forward surface 46, a top surface 48 and a back surface 50. In the illustrated embodiment, the back surfaces have a more gradual slope in order to facilitate rotation of rotor 20 during ratcheting. This configuration also enhances the strength of the teeth against shearing forces. The forward surfaces, however, have a greater slope in order to facilitate engagement with one another during torquing. In fact, the forward surfaces may have a slope approximately equal to or even swept forward of perpendicular in many embodiments.

Figure 6A:
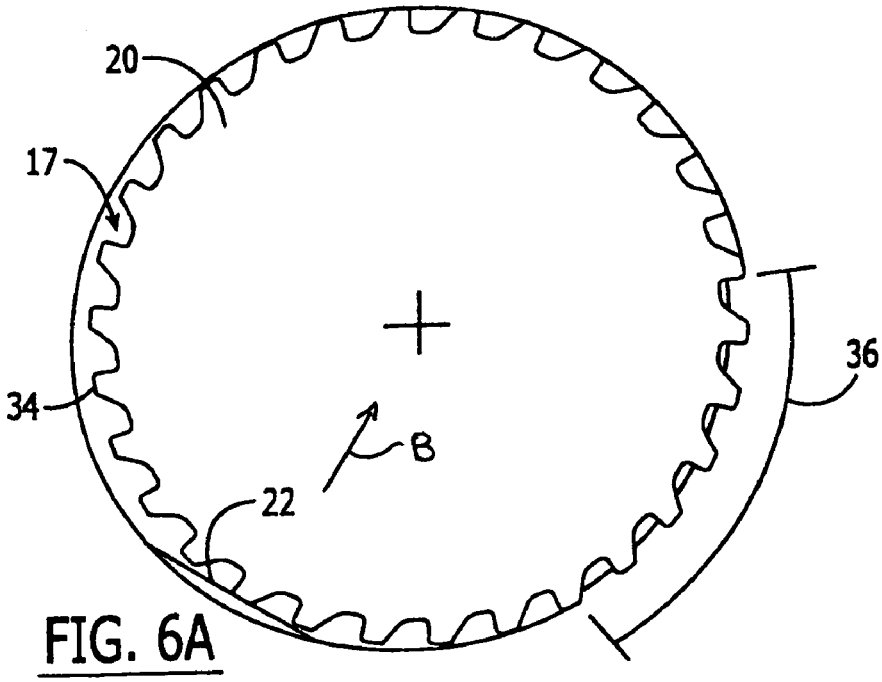
FIGS. 6A and 6B are diagrammatic representations showing operation of the ratchet mechanism in engaged and released modes, respectively.
Figure 6B:
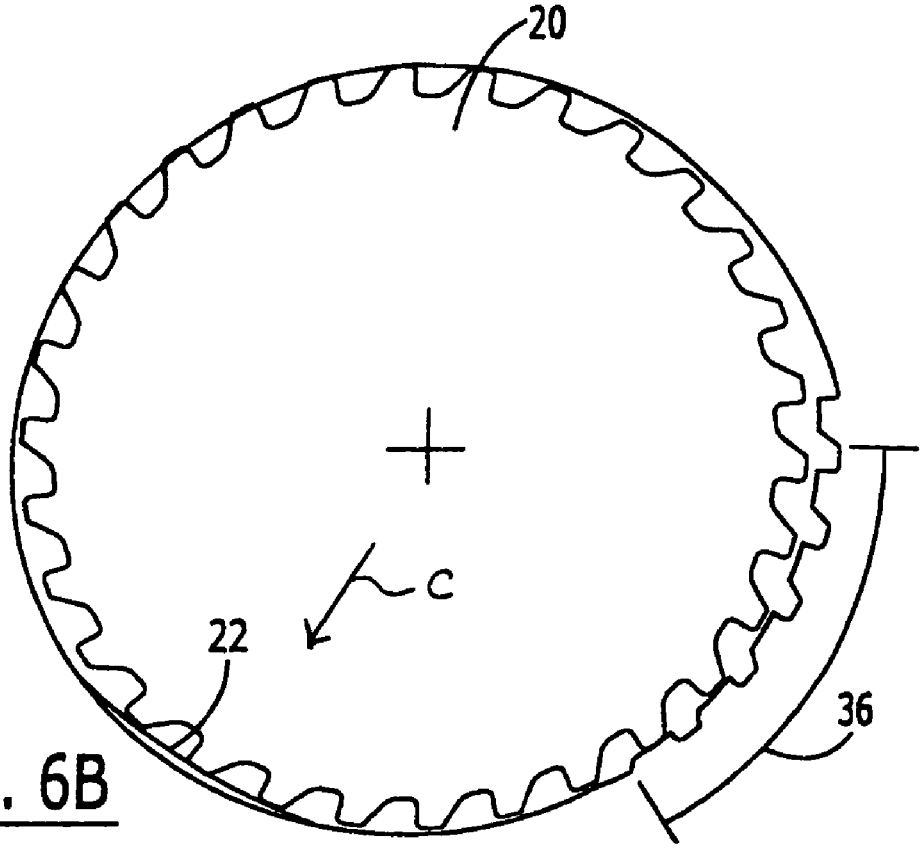

Referring now to FIGS. 6A and 6B, the ratcheting operation of wrench 10 can be most easily explained. The central opening 17 of head 14 is configured to have a diameter slightly greater than the outer diameter of rotor 20. As such, rotor teeth 34 can move in a lateral direction so as to engage and disengage teeth 36. Normally, teeth 34 will be urged into engagement with teeth 36 by spring 22 (as indicated by arrow B), thus allowing the user to torque the nut or other driven component in a first rotational direction.

To ratchet the wrench, the user pulls handle 12 in a generally longitudinal direction so as to move rotor 20 out of engagement with teeth 36 (as indicated by arrow C). Because teeth 34 no longer engage teeth 36, handle 12 can be rotated as desired. The more gradual slopes of back surfaces 44 and 50 facilitate such rotation. Because rotor 20 compresses spring 22 when the wrench is rotated in this manner, spring 22 provides a restoring force to re-engage teeth 34 and 36 once the user slightly releases the longitudinal pull on handle 12.

While preferred embodiments of the invention have been shown and described, modifications and variations may be made thereto by those of ordinary skill in the art without departing from the spirit and scope of the present invention. In addition, it should be understood that aspects of the various embodiments may be interchanged both in whole or in part. Furthermore, those of ordinary skill in the art will appreciate that the foregoing description is by way of example only, and is not intended to limit the invention.

What is claimed is:

1. A wrench comprising:

a handle;

a ratchet head integral with said handle;

said ratchet head defining a chamber having a generally circular sidewall;

a set of sidewall teeth located in said chamber and extending radially inward;

an annular rotor located in said chamber, said rotor having rotor teeth about an outer surface thereof for engaging said sidewall teeth;

a biasing element configured to urge said rotor teeth into engagement with said sidewall teeth; and wherein said sidewall teeth are configured having progressively increasing heights in the direction in which said rotor turns during ratcheting.

2. A wrench as set forth in claim 1, wherein said biasing element comprises a leaf spring.

3. A wrench as set forth in claim 1, wherein said sidewall teeth are located in a distal hemisphere of said ratchet head.

4. A wrench as set forth in claim 3, wherein said biasing element is located in said distal hemisphere of said ratchet head.

5. A wrench as set forth in claim 4, wherein said biasing element comprises a leaf spring.

6. A wrench as set forth in claim 1, wherein said progressively increasing heights of said sidewall teeth follow the path of a gradual spiral originating ahead of a first tooth in said set.

7. A wrench as set forth in claim 1, wherein said rotor teeth are configured having a front surface and a back surface interconnected by a top surface.

8. A wrench as set forth in claim 1, further comprising first and second end plates located on respective sides of said ratchet head to maintain said rotor in said chamber.

9. A wrench as set forth in claim 1, wherein said rotor defines a central opening therethrough.

10. A wrench as set forth in claim 9, wherein said central opening has a multi-point surface for engaging a fastener.

11. A wrench comprising:

a handle;

a ratchet head integral with said handle;

said ratchet head defining a chamber having a generally circular sidewall;

a set of sidewall teeth located in said chamber and extending radially inward;

an annular rotor located in said chamber, said rotor having rotor teeth about an outer surface thereof for engaging said sidewall teeth;

a biasing element configured to urge said rotor teeth into engagement with said sidewall teeth; and wherein said rotor teeth are configured having a front surface and a back surface interconnected by a top surface, said back surface of each said rotor tooth having a more gradual slope in comparison with said front surface thereof.

12. A wrench as set forth in claim 11, wherein said front surface has a slope canted forward of perpendicular.

13. A ratcheting tool comprising:

a ratchet head defining a chamber having a generally circular sidewall;

a set of sidewall teeth located in said chamber and extending radially inward;

an annular rotor located in said chamber, said rotor having rotor teeth about an outer surface thereof for engaging said sidewall teeth; and said sidewall teeth being configured having progressively increasing heights in the direction in which said rotor turns during ratcheting.

14. A ratcheting tool as set forth in claim 13, further comprising a biasing element configured to urge said rotor teeth into engagement with said sidewall teeth.

15. A ratcheting tool as set forth in claim 14, wherein said biasing element comprises a leaf spring.

16. A ratcheting tool as set forth in claim 13, wherein said progressively increasing heights of said sidewall teeth follow the path of a gradual spiral originating ahead of a first tooth in said set.

17. A ratcheting tool as set forth in claim 13, wherein said rotor teeth are configured having a front surface and a back surface interconnected by a top surface.

18. A ratcheting tool as set forth in claim 17, wherein said back surface of each said rotor tooth has a more gradual slope in comparison with said front surface thereof.

19. A ratcheting tool as set forth in claim 18, wherein said front surface has a slope canted forward of perpendicular.

* * * * *